US009867441B2

(12) United States Patent
Hodges

(10) Patent No.: US 9,867,441 B2
(45) Date of Patent: Jan. 16, 2018

(54) SHOWCASE LUGGAGE FOR SHOES

(71) Applicant: Danika Iarivia Hodges, Pleasant Hill, CA (US)

(72) Inventor: Danika Iarivia Hodges, Pleasant Hill, CA (US)

( * ) Notice: Subject to any disclaimer, the term of this patent is extended or adjusted under 35 U.S.C. 154(b) by 243 days.

(21) Appl. No.: 14/838,035

(22) Filed: Aug. 27, 2015

(65) Prior Publication Data

US 2017/0055663 A1 Mar. 2, 2017

(51) Int. Cl.

| | |
|---|---|
| ***A45C 5/02*** | (2006.01) |
| ***A45C 13/02*** | (2006.01) |
| ***A45C 5/14*** | (2006.01) |
| ***A45C 3/12*** | (2006.01) |
| ***A45C 7/00*** | (2006.01) |
| ***A45C 15/06*** | (2006.01) |
| *A47F 7/08* | (2006.01) |

(52) U.S. Cl.

CPC ..... *A45C 13/02* (2013.01); *A45C 3/12* (2013.01); *A45C 5/14* (2013.01); *A45C 7/0045* (2013.01); *A45C 15/06* (2013.01); *A45C 2200/10* (2013.01); *A47F 7/08* (2013.01)

(58) Field of Classification Search

CPC .. A45C 13/02; A45C 3/12; A45C 5/14; A45C 7/0045; A45C 15/06; A45C 2200/10; A45F 7/08

See application file for complete search history.

(56) References Cited

U.S. PATENT DOCUMENTS

| | | | | |
|---|---|---|---|---|
| 5,474,162 | A | 12/1995 | Shyr et al. | |
| 6,286,462 | B1 * | 9/2001 | Burns | A01K 1/0254 119/497 |
| 6,446,577 | B1 * | 9/2002 | Salahor | A01K 1/0254 119/470 |
| 6,471,060 | B1 | 10/2002 | Leyshon | |
| D583,152 | S | 12/2008 | Keeny | |
| 8,005,189 | B2 * | 8/2011 | Ripp | A45C 13/02 190/102 |
| 8,240,470 | B2 * | 8/2012 | Pidgeon | A45C 11/00 206/438 |
| 8,733,577 | B2 * | 5/2014 | Patterson | A45F 3/46 206/192 |
| 2002/0108828 | A1 * | 8/2002 | Soskin | A45C 1/024 190/112 |
| 2004/0045852 | A1 * | 3/2004 | Tidey | B62B 1/10 206/423 |
| 2005/0011715 | A1 | 1/2005 | Goodshaw et al. | |
| 2005/0045520 | A1 * | 3/2005 | Johnson | A45C 11/20 206/542 |
| 2005/0236290 | A1 * | 10/2005 | Ohi | A01K 97/06 206/373 |

(Continued)

*Primary Examiner* — Tri Mai

(74) *Attorney, Agent, or Firm* — Mark H. Plager

(57) ABSTRACT

Some embodiments of the present disclosure include a piece of luggage for storing, transporting, and showcasing shoes. The piece of luggage may include a body having an interior and a closable cover configured to close off the interior and a display case mounted within the interior of the body, the display case comprising at least one transparent display window. The display case may be sized and shaped to accommodate at least one pair of shoes, and the shoes may be viewable through the display window from an exterior of the display case and from an exterior of the piece of luggage.

3 Claims, 4 Drawing Sheets

(56) References Cited

U.S. PATENT DOCUMENTS

| | | | | |
|---|---|---|---|---|
| 2009/0293999 | A1* | 12/2009 | Bravo-Olsher | A45C 1/02 150/104 |
| 2009/0294499 | A1* | 12/2009 | McKinney | A45C 13/08 224/576 |
| 2011/0259693 | A1 | 10/2011 | Nascarella | |
| 2013/0098721 | A1 | 4/2013 | Lai | |
| 2014/0224390 | A1 | 8/2014 | Nikakhtar | |

* cited by examiner

SHOWCASE LUGGAGE FOR SHOES

BACKGROUND

The embodiments herein relate generally to luggage, and more particularly, to a piece of luggage for storing and showcasing shoes.

Conventional luggage is not designed specifically to store, transport, and showcase shoes. Shoes tend to get damaged or squished when placed in a conventional carry-on and, when placed in checked luggage, shoes tend to get damaged going through baggage claim.

Therefore, what is needed is a piece of luggage specifically designed to store, transport, and showcase shoes.

SUMMARY

Some embodiments of the present disclosure include a piece of luggage for storing, transporting, and showcasing shoes. The piece of luggage may include a body having an interior and a closable cover configured to close off the interior and a display case mounted within the interior of the body, the display case comprising at least one transparent display window. The display case may be sized and shaped to accommodate at least one pair of shoes, and the shoes may be viewable through the display window from an exterior of the display case and from an exterior of the piece of luggage.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
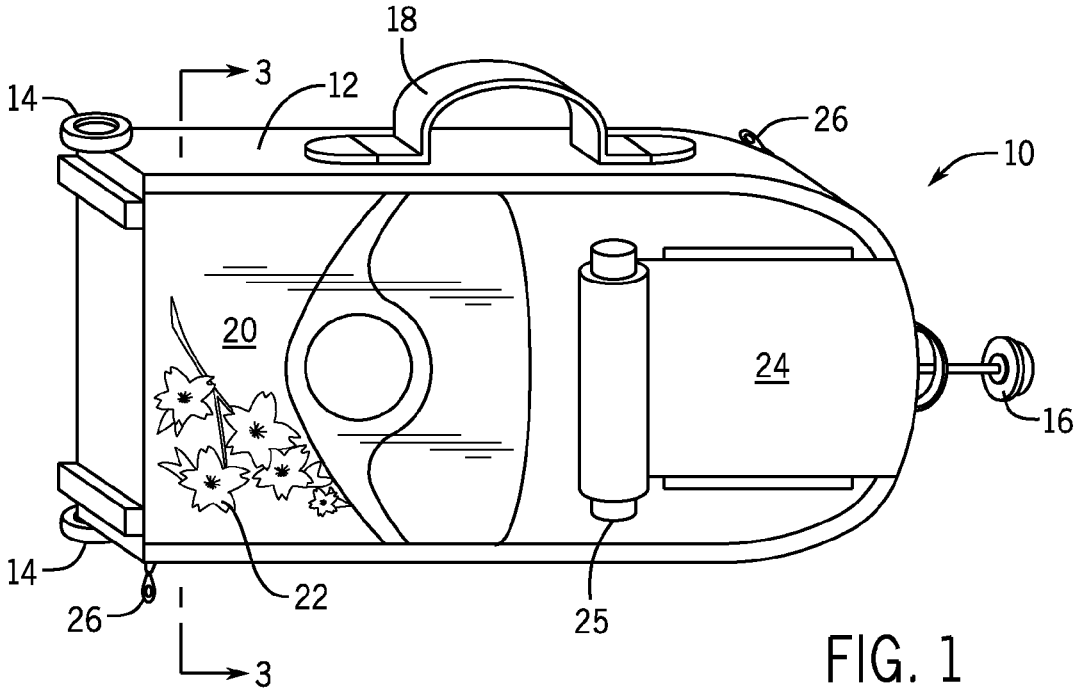
FIG. 1 is a front perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to store, transport, and showcase shoes and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Body
2. Transparent Display Case
3. Gate

The various elements of the luggage for storing, transporting, and showcasing shoes of the present disclosure may be related in the following exemplary fashion. It is not intended to limit the scope or nature of the relationships between the various elements and the following examples are presented as illustrative examples only.

By way of example, and referring to FIGS. 1-7, some embodiments of shoe storage, transport, and showcase product of the present disclosure comprise a piece of luggage 10 comprising a body 12 with an interior and a closable cover 20 configured to close off the interior, a display case, such as a substantially rectangular-shaped display case 36 or a substantially triangularly-shaped display case 40, mounted within the interior of the body 12, the display case comprising at least one transparent display window 37, wherein the display case is configured to accommodate at least a pair of shoes 38 and the shoes 38 are viewable through the display window 37.

Figure 4:
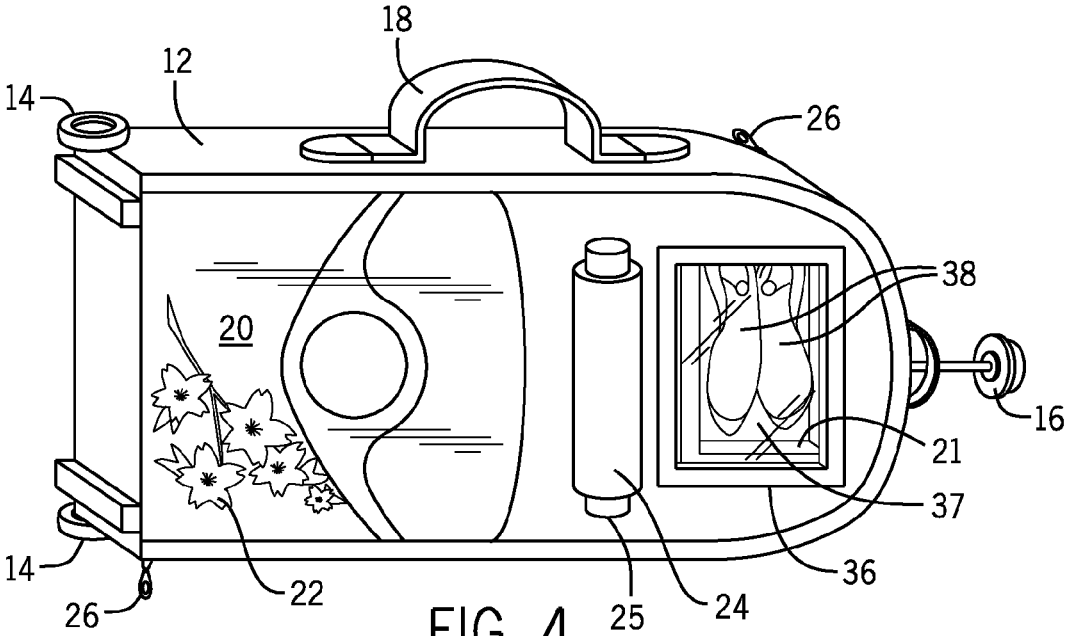
FIG. 4 is a perspective view of one embodiment of the present disclosure.
Figure 6:
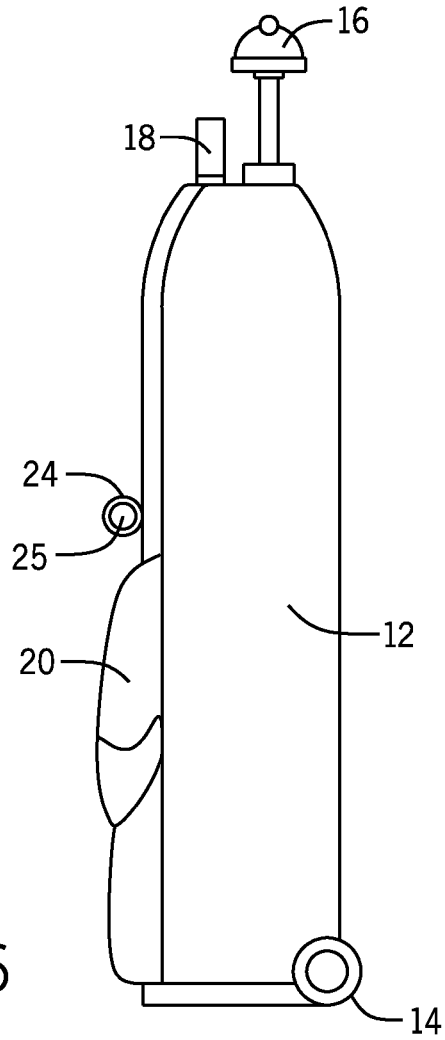
FIG. 6 is a side view of one embodiment of the present disclosure.

In embodiments, the closable cover 20 may comprise a viewing orifice 21 through which the display case may be seen. The product may further comprise a gate 24 to removably cover the viewing orifice 21, at the user's discretion. For example, as shown in FIGS. 1, 4, and 6, the gate 24 may comprise a rollable panel operatively attached to a gate cover roller 25, wherein when the user is done displaying the shoes 38, the rollable panel may extend upwards over the viewing orifice 21, blocking the shoes 38 and display case from site. On the other hand, when the user wants to display the shoes 38 in the display case, the rollable panel may wrap around the gate cover roller 25. However, in other embodiments, the gate 24 may comprise any other suitable device to removably cover the viewing orifice 21. Moreover, in some embodiments, the gate 24 may be either manually or electronically controlled. Thus, a user may manually place the gate 24 over the viewing orifice 21 to conceal the viewing orifice 21, or the gate 24 may electronically close over the viewing orifice 21 by, for example, a push of a button.

Figure 2:
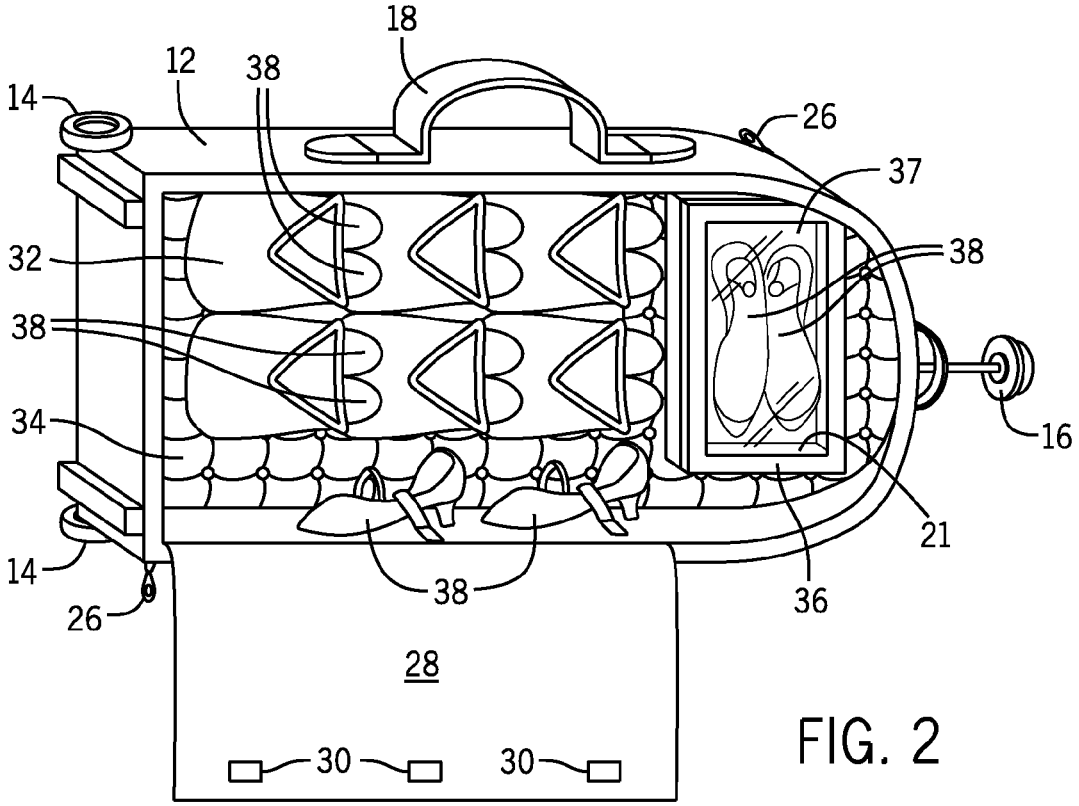
FIG. 2 is a front perspective view of one embodiment of the present disclosure.
Figure 3:
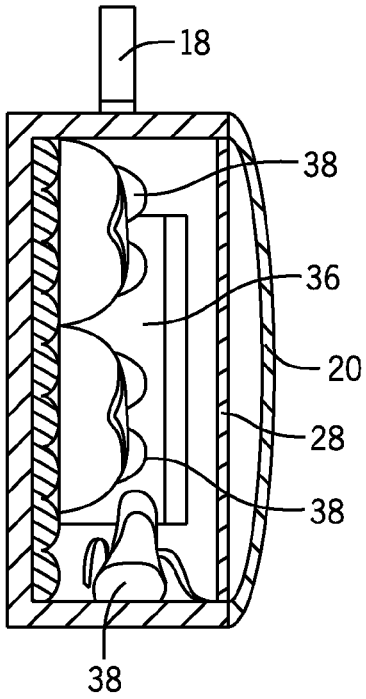
FIG. 3 is a cross-sectional view of one embodiment of the present disclosure, taken along line 3-3 in FIG. 1.

As shown in FIG. 2, the display case may only take up a portion of the interior of the body 12, such that there is additional storage room in the interior of the body 12 for other items. In some embodiments, the additional storage room may comprise a plurality of shoe pockets 32, each configured to accommodate a pair of shoes 38. For example, the interior of the body 12 may comprise the display case and about six shoe pockets 32. The interior may further comprise a flap cover 28 configured to removably cover the portion of the interior comprising the shoe pockets 32, as shown in FIGS. 2 and 3. Thus, in embodiments, the flap cover 28 may fasten to the body using a fastener, such as hook and loop fastener 30, covering the shoe pockets 32. The decorative cover 20 may then cover the entire interior, including the display case, to close the body 12. In some embodiments, the decorative cover 20 may be secured shut using a fastener, such as a zipper 26. An exterior surface of the decorative cover 20 may also comprise decorations 22 printed or otherwise applied thereto.

Figure 5:
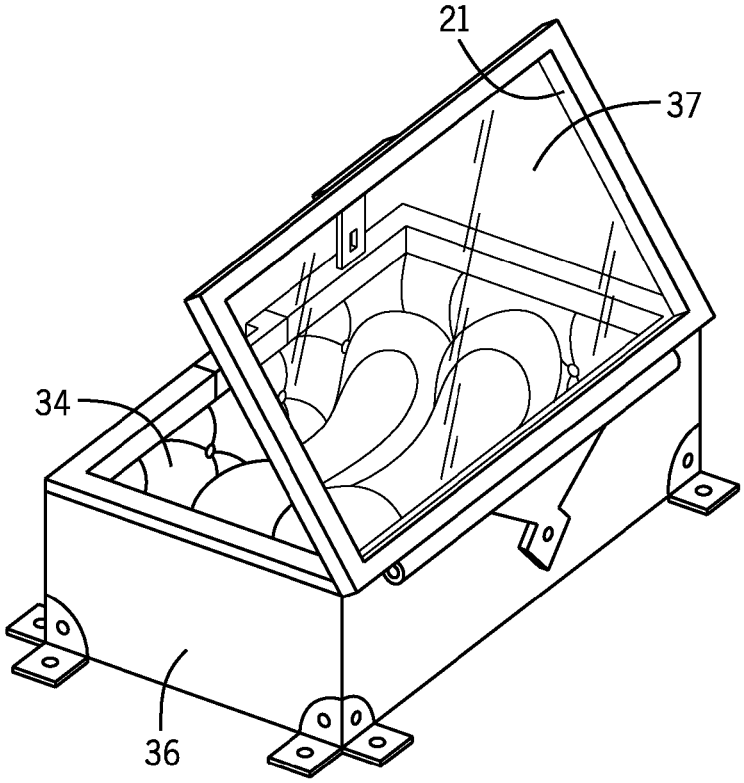
FIG. 5 is a perspective view of one embodiment of the transparent display case of the present disclosure.
Figure 7:
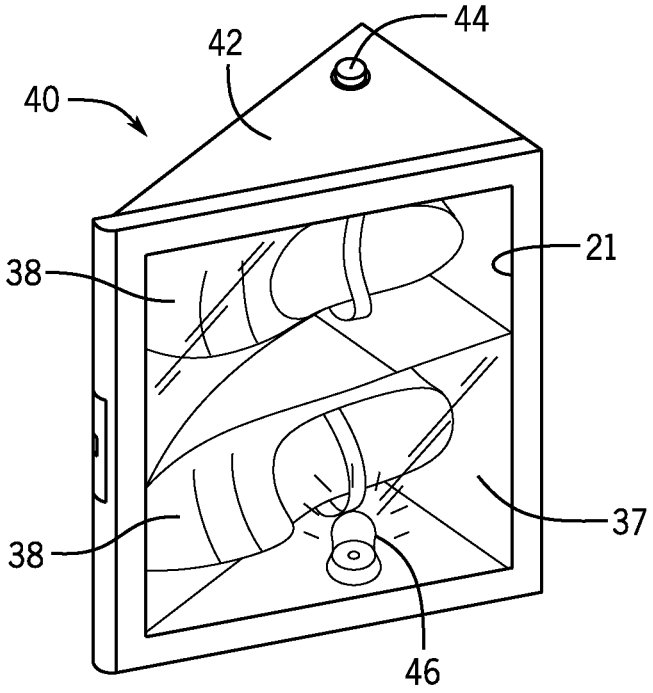
FIG. 7 is a perspective view of an alternate embodiment of the transparent display case of the present disclosure.

As shown in FIG. 5, the display case 36 may be substantially rectangular in shape. Alternatively as shown in FIG. 7, the display case 40 may be substantially triangular in shape. In either case, the display case 36, 40 may be sized and shaped to accommodate at least a pair of shoes 28. The display case 36, 40 may comprise an openable display window 37, such that shoes 38 stored therein may be viewable from an exterior of the display case 36, 40. For example, in some embodiments, the display window 37 may be hingeably attached to a frame of the display case and may latch shut. The interior of the display case 36, 40 may comprise any necessary structure for keeping the shoes 38 in place, such as a soft mesh 34 or a partition. The interior of the display case 36, 40 may also be lighted by, for example, light 46. In embodiments, a user may manually turn the light 46 on and off by pressing button 44 on an exterior of the display case 36, 40. The interior of the body 12 may also comprise soft mesh 34.

The exterior of the luggage 10 may comprise additional features similar to conventional luggage. For example, the exterior of the luggage 10 may comprise a side handle 18 attached to a side thereof, wherein the luggage 10 may be carried using side handle 18. The luggage 10 may also comprise an extending handle 48 attached to a surface thereof, wherein the extending handle 48 is configured to extend outwardly from the luggage 10 to a desired height, wherein a user may pull the luggage 10 by the extending handle 48. A surface of the luggage 10 opposite the extending handle 48 may comprise a pair of wheels 14, such that the luggage 10 can roll along a ground surface while being puled by the extending handle 48. In some embodiments, the luggage 10 may further comprise an extension handle 16, wherein the extension handle 16 may comprise a substantially circular handle attached to an end of a telescoping pole distal from the luggage 10. The extension handle 16 may extend outwardly from the luggage 10 and may be used in addition to or in place of the extending handle 48 to pull the luggage 10.

To use the luggage 10 of the present disclosure, a user may place his or her belongings in the interior of the luggage 10, wherein shoes 38 may be positioned in the display case 36, 40 and in shoe pockets 32. The luggage 10 may then be closed by securing the display window 37 shut, fastening the flap cover 28 shut, and closing the closable cover 20. If a user desires to display his or her shoes 38 in the display case 36, 40 from an exterior of the luggage 10, the user may open the gate 24, such that a viewing orifice 21 in the closable cover 20 is exposed, in turn exposing the shoes 38 in the display case 36, 40. The user may also, optionally, illuminate the display case 36, 40 by pressing button 44 to turn on light 46. When the user has finished displaying the shoes 38, the user may either manually or electronically close gate 24. Because of the structure of the luggage 10, a user may be able to transport, store, and showcase shoes 38 without damaging the shoes 38. The user may also pull and travel with luggage 10 similar to traveling with conventional luggage. In some embodiments, the luggage 10 may be sized and shaped such that it meets the requirements for airplane carry on luggage.

The piece of luggage 10 of the present disclosure may be made of any suitable materials and, in some embodiments, may comprise a lightweight material, such as vinyl.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A piece of luggage for storing, transporting, and showcasing shoes, the piece of luggage comprising:

a suitcase having a body comprising an interior and a closable cover;

a display case with a transparent display window mounted within the interior of the body, wherein the closable cover is configured to close over the display case;

a viewing orifice in the closable cover configured to align with the display case such that the display case is viewable from an exterior of the suitcase;

a gate operatively attached to the closable cover, the gate configured to removably cover the viewing orifice;

an extendable handle configured to outwardly extend from the suitcase; and a pair of wheels on a surface of the suitcase opposite the extendable handle, wherein the display case is configured to accommodate a pair of shoes.

2. The piece of luggage of claim 1, wherein an interior of the display case comprises mesh to secure the pair of shoes in place.

3. The piece of luggage of claim 1, wherein:

the display case only takes up a portion of the interior of the body, such that there is additional storage room in the interior of the body; and the additional storage room comprises a plurality of shoe pockets, each configured to accommodate a pair of shoes.

* * * * *